US007503270B2

(12) United States Patent
Wieczorek

(10) Patent No.: US 7,503,270 B2
(45) Date of Patent: Mar. 17, 2009

(54) BOBBIN SYSTEM FOR USE WITH A SEWING MACHINE

(75) Inventor: Joseph P. Wieczorek, Lake Orion, MI (US)

(73) Assignee: Irvin Automotive Products, Inc., Pontiac, MI (US)

( * ) Notice: Subject to any disclaimer, the term of this patent is extended or adjusted under 35 U.S.C. 154(b) by 53 days.

(21) Appl. No.: 11/591,812

(22) Filed: Nov. 2, 2006

(65) Prior Publication Data

US 2008/0105180 A1 May 8, 2008

(51) Int. Cl.
*D05B 59/00* (2006.01)
*D05B 63/00* (2006.01)

(52) U.S. Cl. ..... 112/185; 112/302

(58) Field of Classification Search ..... 112/184, 112/186, 278, 302, 229; 242/130, 137.1, 242/146, 118, 118.41, 129.6, 129.1, 137, 242/118.7

See application file for complete search history.

(56) References Cited

U.S. PATENT DOCUMENTS

| | | | | | |
|---|---|---|---|---|---|
| 296,790 | A | | 4/1884 | Smith | |
| 398,000 | A | * | 2/1889 | Pratt | 242/129.6 |
| 1,928,590 | A | | 9/1933 | Grieb | |
| 2,340,184 | A | * | 1/1944 | Gray | 225/33 |
| 2,543,475 | A | * | 2/1951 | Slodysko | 112/229 |
| 3,259,335 | A | * | 7/1966 | Rosen | 242/129.1 |
| 3,302,903 | A | * | 2/1967 | Vogel | 242/137.1 |
| 3,347,193 | A | | 10/1967 | Perri | |
| 3,381,642 | A | * | 5/1968 | Bono | 112/229 |
| 3,400,530 | A | * | 9/1968 | Heimes et al. | 57/58.83 |
| 3,434,590 | A | * | 3/1969 | Laughlin et al. | 223/109 R |
| 3,698,546 | A | * | 10/1972 | Kass | 242/137.1 |
| 3,719,332 | A | * | 3/1973 | McLain | 242/125.1 |
| 3,747,870 | A | * | 7/1973 | Bonis et al. | 242/137.1 |
| 4,137,858 | A | | 2/1979 | Stapel et al. | |
| 4,141,519 | A | * | 2/1979 | Tarrson et al. | 242/137.1 |
| 4,157,691 | A | | 6/1979 | Cerliani | |
| 4,184,652 | A | | 1/1980 | Rovin | |
| 4,188,902 | A | | 2/1980 | Kahan | |
| 4,217,839 | A | * | 8/1980 | Barat | 112/229 |
| 4,235,178 | A | | 11/1980 | Ackermann | |
| 4,434,734 | A | | 3/1984 | Russell | |
| 4,458,613 | A | * | 7/1984 | Eguchi et al. | 112/184 |
| 4,769,982 | A | * | 9/1988 | Kogiso et al. | 57/281 |
| 4,998,685 | A | * | 3/1991 | Spencer | 242/137 |
| 5,025,737 | A | | 6/1991 | Kamiya | |
| 5,449,128 | A | * | 9/1995 | Crisci, Jr. | 242/580 |
| 5,718,181 | A | | 2/1998 | Shinozuka et al. | |
| 6,659,384 | B2 | | 12/2003 | Milanese et al. | |
| 7,100,856 | B2 | * | 9/2006 | Murphy, Jr. | 242/118.41 |

* cited by examiner

*Primary Examiner*—Ismael Izaguirre
(74) *Attorney, Agent, or Firm*—Raggio & Dinnin, P.C.

(57) ABSTRACT

A bobbin system for use with a sewing machine is disclosed. The system includes a bobbin and a thread wound around the bobbin. The system also includes an anti-unwinding member arranged around the thread to ensure that the thread does not dislodge and unwind off of the bobbin thus reducing or eliminating entanglements and jamming of the moving parts of the sewing machine.

13 Claims, 2 Drawing Sheets

BOBBIN SYSTEM FOR USE WITH A SEWING MACHINE

BACKGROUND OF THE INVENTION

1. Field of the Invention

This subject invention generally relates to sewing machines, and more particularly relates to a bobbin system having an anti unwinding member for use with a sewing machine using a monofilament thread.

2. Description of Related Art

The use of bobbins with a sewing machine for creating a seam to connect multiple pieces of fabric or two pieces of fabric to one another is well known. Using sewing machines to connect automotive fabric materials to one another in order to make covers for seats, armrests or other interior components is also well known in the art. These sewing machines are capable of making any known seam for automotive vehicles or any other type of application, such as but not limited to, French seams, single seams, zigzag seams and the like. These sewing machines generally have threads stored or wound around spools or bobbins for use in creating the stitches found in every day automotive applications and every day applications that use sewing machines, such as clothing manufacturers and the like. Bobbins store the thread and are either arranged within a pocket or on a bobbin post of a sewing machine and feed the thread to a needle during the sewing operation that sews pieces of material to one another. Many prior art bobbins include a mechanism that feed the thread to the needles via a predetermined pathway.

Some of these prior art sewing machines use threads that are made out of natural material, such as cotton, silk, etc. However, in some specialized applications in the automotive industry and other industries where predetermined tear rates are needed for seams to release airbags or other protective equipment, the use of monofilament thread or members has become common in the sewing industry. The use of these monofilament or plastic like members creates a storage problem for the monofilament thread that is wound around a bobbin or spool or the like for a sewing machine. The monofilament member generally is stiffer and displays a predetermined natural spring coefficient when wound around a bobbin or spool. It has been shown in the prior art that after a bobbin wound with monofilament thread or member is arranged within a sewing machine pocket or over a bobbin post it may begin to unwind thus affecting the feeding of the monofilament member to the sewing machine needle and may also lead to jamming of the bobbin mechanism via the monofilament thread interacting with other components surrounding the bobbin. The unwinding of the monofilament member from the bobbin increases down time of the sewing machine and hence manufacturing line for the automotive materials and fabrics being processed therein.

Therefore, there is a need in the art for an improved methodology of holding monofilament fiber in its wound position around a bobbin or spool. There also is a need in the art for an improved bobbin system that will allow for monofilament fiber to be passed to a needle of a sewing machine without entanglement of the monofilament fiber with other components of the sewing machine and without entanglement of the monofilament fiber with the rotational mechanisms surrounding the bobbin arranged within a pocket or around a bobbin post of the sewing machine. Also there is a need in the art for a generally C-shaped anti-unwinding member for use with a bobbin to create a more efficient process for releasing wound monofilament thread to a sewing needle in a sewing machine environment. Furthermore, there is a need in the art for an easy design and more efficient process of holding a monofilament fiber around a bobbin via the use of a C-shaped anti-unwinding member.

SUMMARY OF THE INVENTION

One object of the present invention may be to provide an improved bobbin system for use with a sewing machine.

Another object of the present invention may be to provide an improved bobbin system for use in a sewing machine wherein the bobbin has monofilament thread wound thereabout.

Still another object of the present invention may be to provide a bobbin system that includes a generally C-shaped anti-unwinding member for use in holding a thread about a bobbin.

Still another object of the present invention may be to provide a bobbin system that increases the efficiencies and reduces the downtime of a manufacturing line.

Another object of the present invention may be to provide an anti-unwinding member having a generally C-shaped body with a predetermined thickness and a predetermined sized opening.

Still another object of the present invention may be to provide an anti-winding member that is capable of being used on a variety of sewing machines and a variety of bobbins.

To achieve the foregoing objects, a bobbin system for use with a sewing machine is disclosed. The bobbin system includes a bobbin and a thread wound around the bobbin. The system also includes an anti-unwinding member arranged around the thread within the bobbin.

One advantage of the present invention may be that it provides a novel and improved bobbin system for use with a sewing machine.

Still a further advantage of the present invention may be that it uses a bobbin system that has an anti-unwinding member generally having a C-shaped body.

Still another advantage of the present invention may be that it provides a bobbin system that can accommodate monofilament thread for use in sewing automotive seams.

Still another advantage of the present invention may be that it provides a more efficient way of holding and securing a monofilament thread around a bobbin.

Still another advantage of the present invention may be that it provides a generally plastic C-shaped anti-unwinding member for use with a bobbin.

Still another advantage of the present invention may be that it provides a variety of diameter, width and thickness C-shaped anti-unwinding members for use with a variety of bobbin members using monofilament threads and/or other threads.

Still another advantage of the present invention may be that it allows for proper storage of monofilament thread around a bobbin in a sewing machine environment.

Still another advantage of the present invention may be that it allows for proper release and feeding of a monofilament thread to a sewing machine needle without unwinding of the thread or jamming of sewing machine parts due to the monofilament fiber unwinding from a bobbin.

Other objects, features and advantages of the present invention will become apparent from the subsequent description and the appended claims, taken in conjunction with the accompanying drawings.

DESCRIPTION OF THE EMBODIMENT(S)

Figure 1:
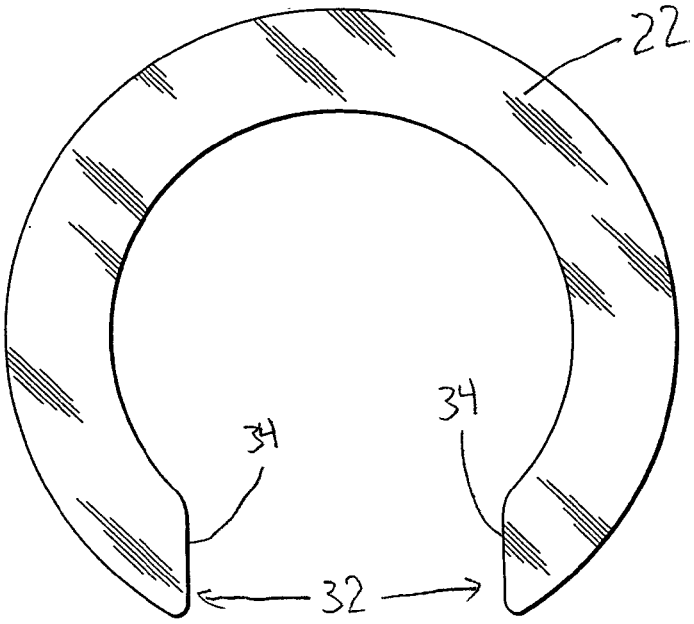
FIG. 1 is a top view of an anti-unwinding member according to the present invention.

Referring to the drawings, a bobbin system 10 for use in a sewing machine 12 is disclosed. The bobbin system 10 is for use in any known sewing machine 12 having a pocket 14 in which a bobbin 16 is arranged or a bobbin post 18 to which a bobbin 16 is arranged thereover. The bobbin 16 will be used to store a predetermined amount of thread 20 for use in sewing seams with the sewing machine 12. Generally, the seams sewn will attach at least two pieces of material to one another or one piece of material to itself. Furthermore, it is also contemplated that the sewing machine 12 will attach a plurality of pieces of material to one another or in any known arrangement. The bobbin 16 may be used to hold and store any known type of thread 20 such as, but not limited to, natural threads, such as cotton, silk, or any known man made material such as monofilament thread or the like. In one contemplated embodiment the bobbin system 10 will hold a predetermined amount of monofilament thread 20 for use in sewing the seams on automotive vehicle seats or other interior components to allow for a more efficient expanding and directing of airbags in a vehicle collision between an occupant and a vehicles interior component. Therefore, the bobbin system 10 of the present invention may be used with any known sewing machine 12 in any known manufacturing environment, such as clothing, automotive vehicle seats, any other vehicle seats or any other type of sewing known. It should further be noted that the bobbin 16 can be of any known size and that the bobbin 16 shown in the drawings is just one of many known bobbins and that the invention can be used with and can be sized to be used with any known sewing machine. In the embodiment shown the bobbin 16 and sewing machine 12 will be used to connect two pieces of material to form a cover for an automobile seat or other interior component.

Figure 2:
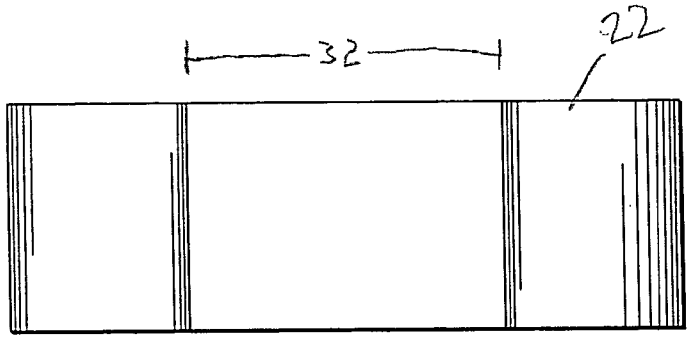
FIG. 2 is a side view of an anti-unwinding member according to the present invention.
Figure 3:
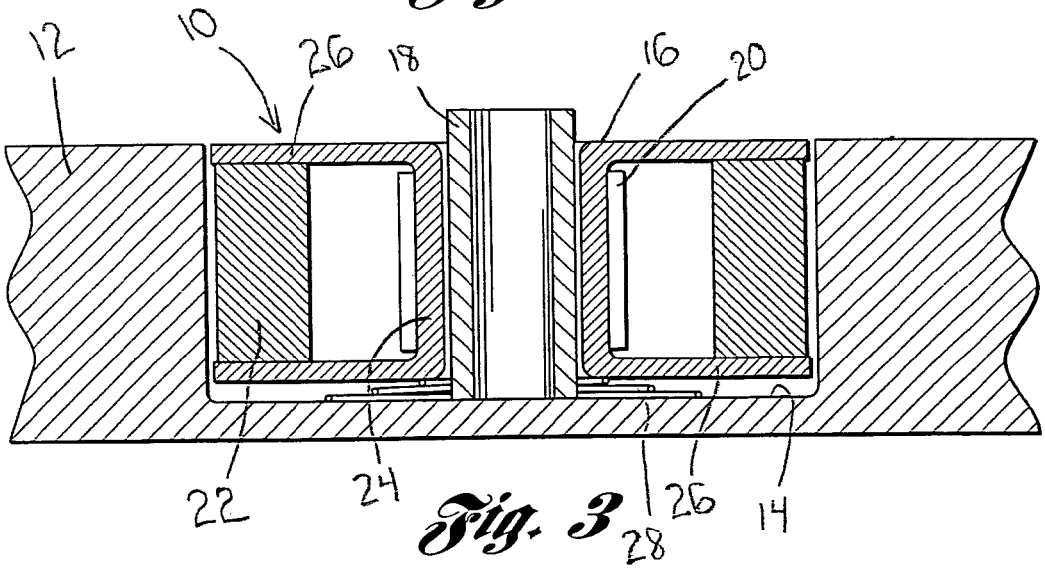
FIG. 3 is a cross sectional view of a bobbin system arranged within a sewing machine according to the present invention.
Figure 4:
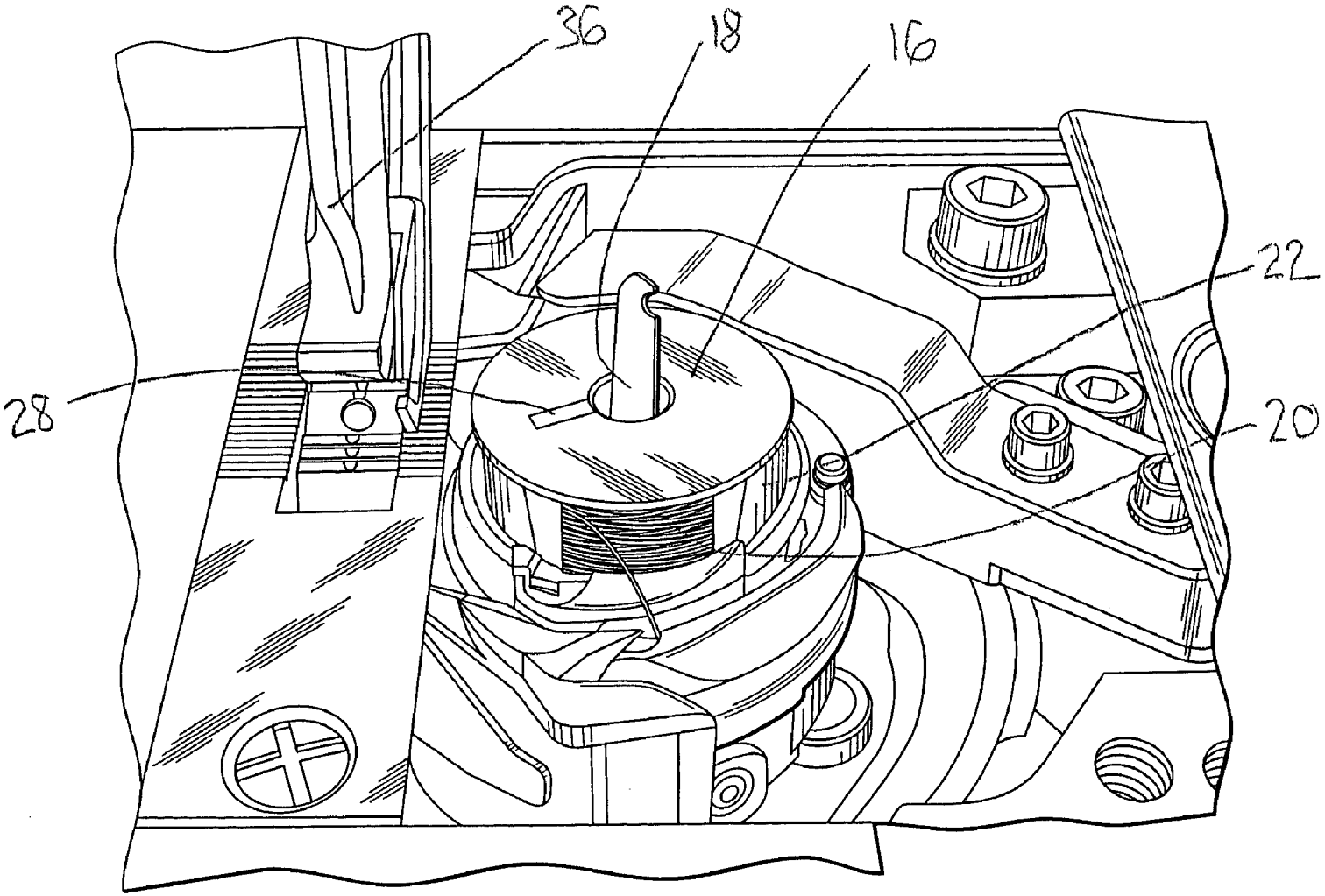
FIG. 4 is a top view of a bobbin system according to the present invention arranged with a sewing machine.

As shown in FIGS. 1 through 4, the bobbin system 10 includes an anti-unwinding member 22 for use in a sewing machine 12 for connecting at least a first and second material for an automobile seat or the like is disclosed. The bobbin system 10 includes a bobbin 16. The bobbin 10 generally has a hollow axle 24 with two end flanges 26 extending radially from opposite ends of the axle 24. Generally, the flanges 26 and axle 24 define a toroidal space of generally rectangular or square cross section in which the thread 20 is wound around the bobbin 16. The thread 20 generally is wound around the axle 24 to a predetermined diameter thereon. The bobbin 16 may also include a slot 28 arranged through one of the flanges 26 or through both of the flanges 26 extending from the axle 24. The slot 28 may be used for passing the thread 20 therethrough in some contemplated embodiments. It should be noted that the bobbin 16 can be of any known diameter and any known thickness or size depending on the design requirements for the sewing machine 12 in which the bobbin 16 will be used. In one contemplated embodiment the bobbin 16 will be made of a metal material. However, it should be noted that any known metal, ceramic, plastic, composite, or natural material may be used to make the bobbin 16 depending on the design requirements and the environment in which the sewing machine 12 will be used.

The bobbin 16 may be for use on a sewing machine 12 in either a pocket 14 that is arranged within one portion of a sewing machine or on a bobbin post 18 that extends from a predetermined portion of a sewing machine 12. In the embodiment shown a bobbin post 18 is arranged along a mid point of a pocket or bobbin housing 14 arranged within a predetermined portion of the sewing machine 12. The bobbin post 18 will have an outer diameter that generally mimics or is approximately the same as that of the diameter of the hollowed out portion of the bobbin axle 18. In the embodiment shown, but not in all of the embodiments contemplated, a spring 30 will be arranged between a surface of the pocket 14 of the sewing machine 12 and one end of the bobbin 16. As discussed above, the bobbin system 10 according to the present invention can be used in any known sewing machine 12 including personal sewing machines, industrial sewing machines, etc.

The bobbin system 10 also includes an anti-unwinding member 22 arranged within a predetermined portion of the toroidal space defined by the flanges 26 and axle 24 of the bobbin 16. The anti-unwinding member or bobbin surround member 22 generally has a C-shape. The anti-unwinding member 22 generally has an outer diameter that is approximately equal to or less than the outer diameter of the bobbin 16. This will allow for the anti-unwinding member 22 to be fully inserted within the bobbin 18 to ensure smooth unwinding of the thread 20 arranged around the bobbin 16 without interference from the anti-unwinding member 22. The anti-unwinding member 22 generally will have a predetermined sized opening or gap 32 that will generally define the C-shape top view of such member 22. The opening 32 may be defined by a flat edge 34 on each end thereof or may have a predetermined curved edge, depending on the design requirements and the bobbin system 10 in which the anti-unwinding member 22 will be used.

In one contemplated embodiment the anti-unwinding member 22 is made of a plastic material, however it should be noted that any known metal, ceramic, composite, plastic material or natural material may be used to make and form the anti-unwinding member 22 according to the present invention. The anti-unwinding member 22 will be arranged over the thread 20 that is wound around the bobbin axle 24 such that the anti-unwinding member 22 will generally surround the thread 20 in a complete circular encapsulation except for the portion where the opening 32 is formed within the anti-unwinding member 22. It should be noted that the anti-unwinding member 22 is capable in one contemplated embodiment of rotation with respect to the bobbin 16 and in another contemplated embodiment it will be fixed with respect to the bobbin 16 in the rotational movement sense. It should be noted that the bobbin 16 may have any known inner diameter and outer and any known thickness depending on the design requirements and the bobbin 16 in which the anti-unwinding member 22 will be used. It should also be noted that the anti-unwinding member 22 can be used with any known thread type such as natural materials, i.e., cotton, silk or any other known natural material thread or with plastic like materials, such as a monofilament thread 20. In the one embodiment shown a monofilament thread 20 will be used in conjunction with the anti-unwinding member 22. In one contemplated embodiment at least a portion of the monofilament thread 20 will be in contact with an inner surface of the anti-unwinding member 22 during operation thereof. In the embodiment shown the anti-unwinding member 22 may allow for the monofilament thread 20 to be passed through the opening 32 within the anti-unwinding member 22 or through the slot 28 arranged in at least one of the flanges 26 of the bobbin 16 depending on the design requirements of the sewing machine 12.

In one contemplated embodiment the anti-unwinding member 22 generally will have an outer diameter of anywhere between 10 millimeters to 40 millimeters. However, in one specifically contemplated embodiment it will have an outer diameter of approximately 25.5 millimeters. It should also be noted that the inner diameter of the anti-unwinding member 22 generally will have a range of anywhere from 10 millimeters to 30 millimeters depending on the design requirements of the anti-unwinding member 22. In one contemplated particular embodiment the inner diameter will be that of approximately 17.5 millimeters. The gap or opening 32 of the anti-unwinding member 22 will have a predetermined distance. In one contemplated embodiment the gap 32 may be within the range of five millimeters to 20 millimeters, however in one specifically contemplated embodiment the gap 32 is approximately 12 millimeters. The thickness of the anti-unwinding member 22 also can be of any known thickness depending on the thickness of the bobbin 16 in which the anti-unwinding member 22 will be placed. In one contemplated embodiment the thickness may be in the range of three millimeters to 20 millimeters depending on the design requirements and sewing machine 12 in which the anti-unwinding member 22 will be used. In one specific contemplated embodiment the thickness of the anti-unwinding member 22 is approximately 8.8 millimeters. It should further be noted that the width of the anti-unwinding member 22 may be within the range of two millimeters to 10 millimeters depending on the design requirements of the anti-unwinding member 22. In one specific contemplated embodiment the width of the anti-unwinding member 22 is approximately four millimeters with the width being approximately one millimeter near each end portion of the anti-unwinding member 22 adjacent to the surfaces defining the opening or gap 32 therein. Therefore, in one specifically contemplated embodiment the anti-unwinding member 22 will have an outer diameter of approximately 25.5 millimeters, an inside diameter of approximately 17.5 millimeters, a gap or opening 32 of approximately 12 millimeters and a thickness for approximately 8.8 millimeters. This specifically contemplated anti-unwinding member 22 may be used with a bobbin 16 to create a bobbin system 10 for use in passing a monofilament thread 20 to a sewing needle 36 to allow for the connection of at least two fabrics to form a seat cover or other covering for the interior components of an automotive vehicle.

In operation, the bobbin 16 will be prewound with a predetermined amount of thread 20 around the axle 24 portion thereof. In one contemplated embodiment the thread 20 will be a monofilament thread 20 that will be wound to a predetermined diameter around the axle 24 of the bobbin 16. Next, the user of the bobbin 16 and sewing machine 12 will arrange the anti-unwinding member 22 around the wound monofilament thread 20 and within the toroidal space of the bobbin 16. It should be noted that the approximate thickness of the anti-unwinding member 22 will be the same as the distance between the flanges 26 of the bobbin 16 while the outer diameter of the anti-unwinding member 22 will be approximately the same as the outer diameter of the bobbin 16 in one contemplated embodiment. These dimensions will allow for the anti-unwinding member 22 to be arranged completely within the toroidal space of the bobbin 16 to allow for proper operation of the bobbin 16 within the sewing machine environment. In one contemplated embodiment the anti-unwinding member 22 will rotate with respect to the bobbin 16 thus allowing for the thread 20 to be released through the circumferential space defined by the opening 32 of the anti-unwinding member 22. However, in another contemplated embodiment the anti-unwinding member 22 will be rotatably fixed with respect to the bobbin 16 and the monofilament thread 20 will pass through slots 28 in the flanges 26 of the bobbin 16 to the sewing machine needle 36 as per the sewing machine design requirements.

After the user places the anti-unwinding member 22 around the monofilament thread 20 wound around the bobbin 16, the bobbin 16 will be arranged over a bobbin post 18 or over a bobbin post 18 and within a pocket 14 of a sewing machine 12 and the thread 20 will be properly laid and threaded to the sewing needle 36 of the sewing machine 12. The thread 20 will then be released from the bobbin 16 pursuant to the speed of the sewing machine 12 during the sewing process which is connecting at least two pieces of fabric by a sewing needle 36 or needles according to the present invention. The use of the anti-unwinding member 22 will ensure that the monofilament thread 20, which generally is stiff and when wound around a bobbin 16 or spool and has a predetermined spring coefficient due to the stiffness inherently found in plastic monofilament thread will stay on the bobbin 16. In prior art systems a bobbin having a monofilament or other stiff type thread may unwind and come off of the bobbin thus jamming the sewing machine and creating down time for the sewing machine and hence the manufacturing line. The anti-unwinding member 22 will ensure that the monofilament thread or other thread 20 will not unwind off of the bobbin 16 thus greatly reducing or eliminating any entanglements of the monofilament thread 20 that may dislodge from the bobbin 16 with the moving parts of the sewing machine 12 thus eliminating down time of the sewing machine and increasing the efficiency of the manufacturing line which is making automobile vehicle seat coverings and the like. The anti-unwinding member 22 will also allow for a more precise and efficient release of the thread 20 to the sewing machine needle 36 by in part ensuring that the monofilament thread 20 stays wound in a predetermined pattern around the axle 24 of the bobbin 16. The use of the anti-unwinding member 22 will help to decrease any crossing of the monofilament thread 20 wound around the bobbin axle 24. Therefore, the use of the anti-unwinding member 22 will greatly increase the efficiency and reduce down time of the sewing machine thus reducing costs for the manufacturer of automobile vehicle seat covers and the like.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A bobbin system for use with a sewing machine, said system comprising:

a bobbin;

a thread wound around said bobbin; and

C-shaped anti-unwinding member arranged around said thread, said anti-unwinding member surrounds said thread in a complete circular encapsulation except for a predetermined portion where a gap is defined in said anti-unwinding member, said anti-unwinding member having an outer diameter that is approximately equal to or less than an outside diameter of said bobbin.

2. The system of claim 1 wherein said thread is a monofilament.

3. The system of claim 1 wherein said gap extends an entire thickness of said anti-unwinding member.

4. The system of claim 3 wherein said gap having a size greater than a diameter of an axle of said bobbin.

5. The system of claim 4 wherein said gap is approximately within a range of 10 mm to 14 mm.

6. The system of claim 1 wherein said anti-unwinding member is made of plastic.

7. A sewing machine, said machine including:

a bobbin post;

a bobbin arranged over said bobbin post;

a monofilament thread wound round said bobbin; and a generally C-shaped anti-unwinding member surrounding said thread, said C-shape member is arranged completely within a toroidal space of said bobbin.

8. The machine of claim 7 further including a pocket, said bobbin arranged within said pocket.

9. The machine of claim 7 wherein said C-shaped member is made of a plastic material.

10. machine of claim 7 wherein said C-shaped member having an outer diameter that is approximately equal to or less than an outer diameter of said bobbin.

11. The machine of claim 7 wherein said C-shaped member having an opening of approximately 10 mm to 12 mm, said C-shaped member will keep said thread from unwinding off of said bobbin.

12. The machine of claim 7 wherein a portion of said thread contacts an inner surface of said C-shape member.

13. A bobbin system for use with a sewing machine, said system comprising:

a bobbin;

a thread wound around said bobbin; and a C-shaped and-unwinding member arranged around said thread, said anti-unwinding member is arranged completely within a toroidal space of said bobbin.

* * * * *

UNITED STATES PATENT AND TRADEMARK OFFICE

CERTIFICATE OF CORRECTION

PATENT NO. : 7,503,270 B2
APPLICATION NO. : 11/591812
DATED : March 17, 2009
INVENTOR(S) : Joseph P. Wieczorek It is certified that error appears in the above-identified patent and that said Letters Patent is hereby corrected as shown below:

Col. 7, Line 10, Claim 7 - Please delete “round” and insert -- around -- after “thread wound”

Col. 8, Line 1, Claim 10 - Please insert missing word -- The -- before “machine of claim 7”

Col. 8, Line 14, Claim 13 - Please delete “and” and insert -- anti -- after “C-shaped”

Signed and Sealed this

Fifth Day of May, 2009

JOHN DOLL
*Acting Director of the United States Patent and Trademark Office*